US011933012B2

(12) United States Patent
Nomoto

(10) Patent No.: US 11,933,012 B2
(45) Date of Patent: Mar. 19, 2024

(54) SHAPE-RETAINING HOIST TYPE RECTANGULAR PARALLELEPIPED BAG HAVING MULTISTAGE CONFIGURATION

(71) Applicants: METRY CO., LTD., Kazo (JP); Futoshi Nomoto, Kazo (JP)

(72) Inventor: Futoshi Nomoto, Kazo (JP)

(73) Assignees: METRY CO., LTD. (JP); Futoshi Nomoto (JP)

( * ) Notice: Subject to any disclaimer, the term of this patent is extended or adjusted under 35 U.S.C. 154(b) by 540 days.

(21) Appl. No.: 17/263,035

(22) PCT Filed: Jul. 27, 2018

(86) PCT No.: PCT/JP2018/028243
§ 371 (c)(1),
(2) Date: Jan. 25, 2021

(87) PCT Pub. No.: WO2020/021703
PCT Pub. Date: Jan. 3, 2020

(65) Prior Publication Data

US 2021/0310208 A1 Oct. 7, 2021

(51) Int. Cl.
*E02B 3/12* (2006.01)
*E02D 29/02* (2006.01)

(52) U.S. Cl.
CPC ..... *E02B 3/127* (2013.01); *E02D 29/0291* (2013.01); *E02D 2200/1628* (2013.01); *E02D 2600/40* (2013.01)

(58) Field of Classification Search
CPC ..... E02B 3/127; E02D 29/0291; E02D 2200/1628; E02D 2600/40; B65D 88/1631; B65D 88/1637
(Continued)

(56) References Cited

U.S. PATENT DOCUMENTS 5,073,035 A * 12/1991 Williams ..... B65D 88/1631 383/17
8,485,757 B2 7/2013 Nomoto
(Continued)

FOREIGN PATENT DOCUMENTS

CN 101796249 A 8/2010
CN 103848118 A 6/2014
(Continued)

OTHER PUBLICATIONS

Machine translation of JP-2008156815-A.*
(Continued)

*Primary Examiner* — Jes F Pascua
(74) *Attorney, Agent, or Firm* — Harness, Dickey & Pierce, P.L.C.

(57) ABSTRACT

A shape-retaining hoist type rectangular parallelepiped bag includes: a rectangular parallelepiped bag that is a generally rectangular parallelepiped-shaped bag that has an internal space to accommodate an accommodated object; a bottom surface holding mechanism configured to hold a bottom surface by application of a tensile force thereto; a side surface holding mechanism configured to hold a side surface by application of a tensile force thereto; a central hanging body configured to extend in a vertical direction with one end thereof being fixed to a center of the bottom surface of the rectangular parallelepiped bag and hold the bottom surface holding mechanism and the side surface holding mechanism at intermediate positions in the vertical direction; and a ring-shaped hook holding portion connected to the other end of the central hanging body, to which a hook is to be attached. This provides a rectangular parallelepiped bag that is less likely to tear despite its small aspect ratio and large height, can compact soil particles by stages in its height direction, has a stable strength even when the bag has a large height as in a case where the bag has a ratio between a height
(Continued)

and a width of the bag exceeding 1:1, for example, and is less likely to be deformed when lifted upwardly in the vertical direction.

19 Claims, 8 Drawing Sheets

(58) Field of Classification Search
USPC ..... 383/16
See application file for complete search history.

(56) References Cited

U.S. PATENT DOCUMENTS

| | | | |
|---|---|---|---|
| 2011/0262056 | A1 | 10/2011 | Nomoto |
| 2014/0154045 | A1 | 6/2014 | Lee et al. |

FOREIGN PATENT DOCUMENTS

| | | | | |
|---|---|---|---|---|
| CN | 204715337 | U | | 10/2015 |
| JP | S58-121887 | U | | 8/1983 |
| JP | S58-194186 | U | | 12/1983 |
| JP | H11-334786 | A | | 12/1999 |
| JP | H11334786 | A | * | 12/1999 |
| JP | 2002-327417 | A | | 11/2002 |
| JP | 3949156 | B1 | | 7/2007 |
| JP | 2008156815 | A | * | 7/2008 |
| JP | 2009-046911 | A | | 3/2009 |
| KR | 200413209 | Y1 | | 4/2006 |
| KR | 101232214 | B1 | | 2/2013 |
| KR | 101386913 | B1 | | 4/2014 |
| TW | 2015-29932 | A | | 8/2015 |

OTHER PUBLICATIONS

Supplementary European Search Report issued for corresponding European Application No. 18927610; dated Jun. 11, 2021 (total 4 pages).

International Search Report (English and Japanese) of the International Searching Authority issued in PCT/JP2018/028243, dated Oct. 16, 2018; ISA/JP (5 pages).

Notice of Allowance issued for the corresponding Chinese Pat. Application No. 2018800959804; dated Jun. 6, 2022 (total 8 pages).

Office Action issued in the corresponding Korean Patent Application No. 10-2021-7005743; dated Jan. 17, 2023 (total 12 pages).

* cited by examiner

SHAPE-RETAINING HOIST TYPE RECTANGULAR PARALLELEPIPED BAG HAVING MULTISTAGE CONFIGURATION

CROSS REFERENCE TO RELATED APPLICATIONS

This application is a U.S. National Phase application of International Application No. PCT/JP2018/028243, filed on Jul. 27, 2018. The entire disclosure of the above application is expressly incorporated by reference herein.

BACKGROUND

Technical Field

The present invention relates to a shape-retaining hoist type rectangular parallelepiped bag used, for example, for improving soft ground.

Related Art

Soft ground containing a large amount of water or liquefiable ground has conventionally required to undergo a construction method for improving the surface layer, such as a sheet construction method, or reinforcement in the deep layer using piles, for example. When such surface layer improvement is adopted, however, subsidence occurs due to the deformation of the sheet if the weak stratum has a large depth. On the other hand, the deep layer construction method such as piling requires special heavy machines. This causes the problem of increased cost in addition to imposing limitations on use conditions. Moreover, before proceeding with the construction work, a makeshift road, or the like, bearable with a load applied from the above also needs to be constructed in advance in order to ensure a work environment in which the heavy machines can be used.

As a measure against such soft ground, the inventors have devised a "modern version of high-standard sandbag" that packs soil and sand in a water-permeable bag including an internal restriction tool and have established a technique for achieving a remarkable load bearing capability and the shortening of the construction period (for example, see Japanese Patent No. 3949156).

FIG. 7A is an explanatory diagram for a conventional rectangular parallelepiped bag 201 including an internal restriction tool 210. The internal restriction tool 210 is held by a bottom surface of the conventional rectangular parallelepiped bag 201, and crushed stones or soil and sand are packed in an internal space as accommodated objects to form a rectangular parallelepiped bag. With such a structure, the accommodated objects therein are compacted by the tensile force of cloth that constitutes the bag, thus preventing the collapse of its shape even when the bag is lifted upwardly. A pressurization-resistant capability against a pressure applied from the above has been dramatically improved, and an experiment has showed a result that the bag can bear a load of 4500 kN/m$^2$ or more. Moreover, because the bag by itself can compact soil particles regardless of ground strength and can maintain its shape, the bag has a function of effectively reinforcing ground and also has a high vibration-reducing capability.

FIG. 7B is a conceptual diagram for explaining shear forces generated by a load applied from the above in the flat rectangular parallelepiped bag 201. An internal frictional angle $\alpha$ of sand and soil or crushed stones packed in the internal space of the rectangular parallelepiped bag 201 is approximately 30° to 45°. Because slip lines due to shear are generated at an angle close to the internal frictional angle of the sand and soil or crushed stones put into the bag, the shear forces SF generated by the accommodated objects as well as the load L applied to the rectangular parallelepiped bag 201 are directly applied to the bottom surface of the bag. The bottom surface is supported by resistance from the ground surface, and thus, there is a low possibility of tearing the cloth constituting the bottom surface by the shear forces SF.

Stacking a large number of such conventional flat rectangular parallelepiped bags 201, however, requires a large workload, and is a complicated procedure. If a rectangular parallelepiped bag that has a large height were to be produced in order to solve such a problem, the condition would change significantly. FIG. 7C shows how shear forces SF are applied to a rectangular parallelepiped bag that has a large height. The shear forces SF generated by a load L applied from the above and the weight of accommodated objects are applied to side surfaces B, thus increasing a possibility of causing the rupture of the cloth. Specifically, large shear forces are applied to side surface portions of the rectangular parallelepiped bag that has a shape with a small length-to-width cost and a large height. As the result, the bag may tear easily, or the shape of the bag may be deformed largely.

FIG. 8A is an explanatory diagram for the conventional flat rectangular parallelepiped bag 201 that includes the internal restriction tool. Because accommodated objects 280 are compacted by the tensile forces of the internal restriction tool 210, the degree of deformation when the bag is lifted is small (see FIG. 8B).

Specifically, the effective range of the internal restriction of the bag in a height direction thereof is approximately equal to a height near the apex of a truss structure formed by the internal restriction tool 210.

FIG. 8C, in contrast, is an explanatory diagram for a rectangular parallelepiped bag that has a small aspect ratio and a large height. When a rectangular parallelepiped bag 205 that has a small aspect ratio and a large height H is lifted, accommodated objects 280 cannot be compacted sufficiently. Thus, the rectangular parallelepiped bag 205 is largely deformed (see FIG. 8D). If the apex of the truss structure is set high in accordance with the height of the bag, a distance from the soil pressure pushed down by the truss structure formed by the internal restriction tool 210 provided in a lower part is increased. Consequently, an amount of time taken for soil particles in the bag to be restricted and solidified becomes longer. As the result, the lower parts of the bag droop down, and the strength also becomes insufficient.

The present invention has been made in light of the foregoing problems. It is an object of the present invention to provide a rectangular parallelepiped bag that is less likely to tear despite its small aspect ratio and large height, can compact soil particles by stages in its height direction, has a stable strength even when the bag has a large height as in a case where the bag has a ratio between a height and a width of the bag exceeding 1:1, for example, and is less likely to be deformed when lifted upwardly in the vertical direction.

SUMMARY (1) The present invention provides a shape-retaining hoist type rectangular parallelepiped bag including: a rectangular parallelepiped bag that is a generally rectangular parallelepiped-shaped bag having an internal space to accommodate an accommodated object; a bottom surface holding mechanism configured to hold a bottom surface by application of a tensile force thereto; a side surface holding mechanism configured to hold a side surface by application of a tensile force thereto; a central hanging body configured to extend in a vertical direction with one end thereof being fixed to a center of the bottom surface of the rectangular parallelepiped bag and hold the bottom surface holding mechanism and the side surface holding mechanism at intermediate positions in the vertical direction; and a ring-shaped hook holding portion connected to the other end of the central hanging body, to which a hook is to be attached.

According to the invention described in the aforementioned (1), the rectangular parallelepiped bag that accommodates the accommodated objects such as soil and sand or crushed stones includes both the bottom surface holding mechanism configured to hold the bottom surface by the application of the tensile force thereto and the side surface holding mechanism configured to hold the side surface by the application of the tensile force thereto. This provides an advantageous effect that the extent over which the accommodated objects are compacted is increased in the vertical direction, and thus a rectangular parallelepiped bag less likely to be deformed and having a small aspect ratio (small oblateness) and a large height can be formed.

(2) The present invention provides the shape-retaining hoist type rectangular parallelepiped bag according to the aforementioned (1) in which: the bottom surface holding mechanism includes at least four hanging bodies with one ends thereof being fixed at positions spaced apart from the center of the bottom surface by a predetermined distance on diagonal lines connecting between opposed apexes of the bottom surface, and the other ends thereof being fixed to the central hanging body; the side surface holding mechanism includes a plurality of side surface restriction bodies that have horizontal components of vectors extending in directions different from those of the hanging bodies as viewed downwardly in the vertical direction from a top surface with one ends of the side surface restriction bodies being fixed to the side surfaces; and the other ends of the side surface restriction bodies are connected in between a hanging body connected portion to which the other ends of the hanging bodies and the central hanging body are connected, and the other end of the central hanging body.

Specifically, the present invention provides the shape-retaining hoist type rectangular parallelepiped bag according to the aforementioned (1) in which: the bottom surface holding mechanism includes at least four hanging bodies with one ends thereof being fixed at positions spaced apart from the center of the bottom surface by a predetermined distance on diagonal lines connecting between opposed apexes of the bottom surface, and the other ends thereof being fixed to the central hanging body; the side surface holding mechanism includes side surface restriction bodies fixed to the hanging bodies in a state of being rotated, for example, by 45° from the bottom surface holding mechanism as viewed downwardly in the vertical direction from the top surface, with one ends of the side surface restriction bodies being fixed to the four side surfaces, respectively; and the other ends of the side surface restriction bodies are connected in between a hanging body connected portion to which the other ends of the hanging bodies and the central hanging body are connected, and the other end of the central hanging body.

According to the invention described in the aforementioned (2), the tensile forces of the hanging bodies that constitute the bottom surface holding mechanism and the tensile forces of the side surface restriction bodies that constitute the side surface holding mechanism have horizontal components of vectors different from one another in the direction parallel to the bottom surface. This provides an advantageous effect that the directions of the forces received from the side surfaces by the accommodated objects interfere with one another, and the entire accommodated objects are thereby compacted.

(3) The present invention provides the shape-retaining hoist type rectangular parallelepiped bag according to (2) described above in which the side surface holding mechanism includes at least four side surface restriction bodies with one ends thereof being fixed at positions spaced apart from the bottom surface by a predetermined distance on perpendicular bisectors of respective sides corresponding to lines of intersection between the side surfaces and the bottom surface.

According to the invention described in aforementioned (3), the directions of the tensile forces of the side surface restriction bodies that constitute the side surface holding mechanism, and the directions of the tensile forces of the hanging bodies that constitute the bottom surface holding mechanism can be changed to the largest degree. This provides an advantageous effect that the directions of the forces received from the side surfaces by the accommodated objects are dispersed, and thus the force to compact the accommodated objects is easily applied in the most uniform manner.

(4) The present invention provides the shape-retaining hoist type rectangular parallelepiped bag according to any one of (1) to (3) described above in which a plurality of mechanisms for compacting an accommodated object, each including the bottom surface holding mechanism and the side surface holding mechanism in this order from the bottom surface, are provided in the vertical direction.

According to the invention described in the above-mentioned (4), there is obtained an advantageous effect that a rectangular parallelepiped bag less likely to be deformed and having a small aspect ratio and a large height can be formed.

(5) The present invention provides the shape-retaining hoist type rectangular parallelepiped bag according to any one of (1) to (4) described above in which a distance between a side surface restriction body fixing plane including a side surface restriction body fixing portion on the side surface to which the one end of the side surface restriction body is fixed and parallel to the bottom surface and a side surface restriction body connected plane including the side surface restriction body connected portion at which the other end of the side surface restriction body is connected to the central hanging body and parallel to the bottom surface is smaller than or equal to 5% of a height.

As the side surface restriction bodies that exert the tensile forces on the side surfaces are oriented closer to positions perpendicular to the side surfaces, the force to compact the accommodated objects is more likely to be applied uniformly. As the result, the accommodated objects are more likely to be compacted uniformly. According to the invention described in the above-mentioned (5), the side surface restriction bodies are stretched so as to be almost perpendicular to the side surfaces. This provides an advantageous effect that the force to compact the accommodated objects is more likely to be applied uniformly, and thus the rectangular parallelepiped bag less likely to be deformed as a whole can be formed.

(6) The present invention provides the shape-retaining hoist type rectangular parallelepiped bag according to any one of (1) to (5) described above in which positions at which the one ends of the hanging bodies are fixed to the bottom surface are in between the center of the bottom surface and the respective apexes.

According to the invention described in the above-mentioned (6), the hanging bodies that constitute the bottom surface holding mechanism are fixed in between the apexes of the bottom surface and the center of the bottom surface. This provides an advantageous effect that the accommodated objects at the bottom, where the vertical soil pressure is largest, are compressed toward a central portion, and thus compaction can be done efficiently. Moreover, there is obtained an advantageous effect that the quick solidification of the accommodated objects at the bottom reduces force applied to the cloth portion of the bottom surface and the sewn portions of the respective members, and thus the cloth that constitutes the bag becomes less likely to tear.

(7) The present invention provides the shape-retaining hoist type rectangular parallelepiped bag according to any one of (1) to (6) described above in which the height is ⅓ or more of a length of a side of the bottom surface.

According to the invention described in the above-mentioned (7), a rectangular parallelepiped bag that has a large height can be formed. This provides an advantageous effect that the number of steps needed if the rectangular parallelepiped bags are to be stacked high in layers can be reduced, and thus the construction work can be completed earlier.

Advantageous Effects of Invention

The shape-retaining hoist type rectangular parallelepiped bags described in the aforementioned (1) to (7) of the present invention can provide an advantageous effect that a rectangular parallelepiped bag less likely to be deformed and having a smaller aspect ratio and a larger height than the conventional techniques can be formed.

DETAILED DESCRIPTION

Figure 1A:
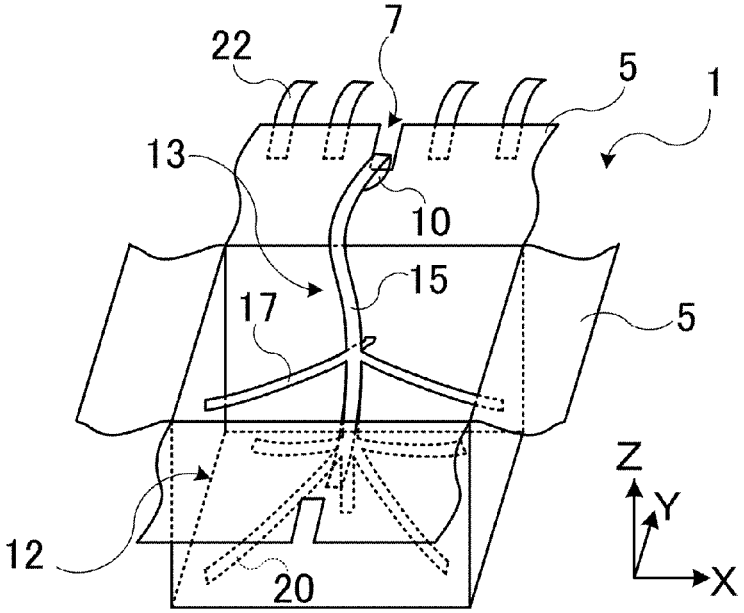
FIG. 1A is an explanatory diagram for a shape-retaining hoist type rectangular parallelepiped bag according to a first embodiment of the present invention.

Embodiments of the present invention will be described below with reference to the accompanying drawings.

FIGS. 1 to 6 show an example of the mode for carrying out the invention, and elements denoted by the same reference numeral in the figures represent the same object. Note that part of the configuration in each figure is omitted as appropriate to simplify the figure. The sizes, shapes, thicknesses, and the like of members are expressed in an exaggerating manner as appropriate.

FIG. 1A is an explanatory diagram for a shape-retaining hoist type rectangular parallelepiped bag 1 (hereinafter referred to as a rectangular parallelepiped bag 1) according to a first embodiment of the present invention. The rectangular parallelepiped bag 1 has a shape of a generally rectangular parallelepiped bag that includes a hollow internal space 12 to accommodate soil and sand, or crushed stones. The rectangular parallelepiped bag 1 includes an opening on a top surface thereof. A durable, flexible material, for example, water-permeable woven fabric using a natural material such as hemp, or chemical fiber such as polypropylene or polyethylene, is preferably used as a material of cloth. Furthermore, such cloth desirably contains an ultraviolet protectant for preventing ultraviolet degradation. Such a material is generally used for a sandbag or a flexible container bag, for example.

The rectangular parallelepiped bag 1 includes an internal restriction tool 13 that holds a bottom portion holding mechanism 50 and a side surface holding mechanism 70. Specifically, the internal restriction tool 13 includes a central hanging body 15. The central hanging body 15 extends in a vertical direction with one end thereof being fixed to the center of a bottom surface of the rectangular parallelepiped bag 1, and also holds the bottom surface holding mechanism 50 and the side surface holding mechanism 70 (see FIG. 3A to be described later) at intermediate positions in the vertical direction. The fixation between the internal restriction tool 13 and the cloth of the rectangular parallelepiped bag 1, and the fixation between hanging bodies 20 or side surface restriction bodies 17 and the central hanging body 15 are preferably made with the use of a sewing method using a resin thread that has a sufficient strength, welding, bolt joint, or an adhesive, for example.

The internal restriction tool 13 further includes a ring-shaped hook holding portion 10 connected to the other end of the central hanging body 15, to which a hook used in hoisting is to be attached.

The bottom surface holding mechanism 50 includes four hanging bodies 20 with one ends thereof being fixed at positions spaced apart from the center of the bottom surface by a predetermined distance on diagonal lines connecting between opposed apexes of the bottom surface, and the other ends thereof being fixed to the central hanging body 15. Specifically, the one ends of the hanging bodies 20 are fixed to the bottom surface 36 at positions in between the center of the bottom surface 36 and the respective apexes, and the hanging bodies 20 form what is called a truss structure when hoisted.

The side surface holding mechanism 60 includes four side surface restriction bodies 17 with one ends thereof being fixed at positions spaced apart from the bottom surface 36 by a predetermined distance on perpendicular bisectors of respective sides corresponding to lines of intersection between side surfaces 38 and the bottom surface 36, and the other ends thereof being connected in between a hanging body connected portion 28 (see FIG. 2A to be described later) to which the other ends of the hanging bodies 20 and the central hanging body 15 are connected, and the other end of the central hanging body 15.

When the rectangular parallelepiped bag 1 is viewed downwardly in the vertical direction (downwardly in the Z direction) from a top surface 40 (see FIG. 2A to be described later), horizontal components (X-Y plane direction) of vectors of the side surface restriction bodies 17 extend in directions different from those of the hanging bodies 20, and the one ends of the side surface restriction bodies 17 are fixed to the side surfaces 38. The other ends of the side surface restriction bodies 17 are connected in between the hanging body connected portion 28 (see FIG. 2A to be described later) to which the other ends of the hanging bodies 20 and the central hanging body 15 are connected. Specifically, the side surface restriction bodies 17 of the side surface holding mechanism 60, as viewed downwardly in the vertical direction from the top surface, are held by the central hanging body 15 in a state of being rotated by 45° from the hanging bodies 20 of the bottom surface holding mechanism 50, and the one ends of the side surface restriction bodies 17 are fixed to the four side surfaces, respectively. The other ends of the side surface restriction bodies 17 are connected in between the hanging body connected portion 28 to which the other ends of the hanging bodies 20 and the central hanging body 15 are connected, and the other end of the central hanging body 15.

Cover portions 5 are connected to the top surface of the rectangular parallelepiped bag 1. A pair of opposed cover portions 5 is configured to include openings 7 so that the hook holding portion 10 extending from the central hanging body 15 protrudes therethrough to the outside of the rectangular parallelepiped bag.

Note that a height H of the rectangular parallelepiped bag 1 is preferably ⅓ or more of a length W of the side of the bottom surface 36.

Figure 1B:
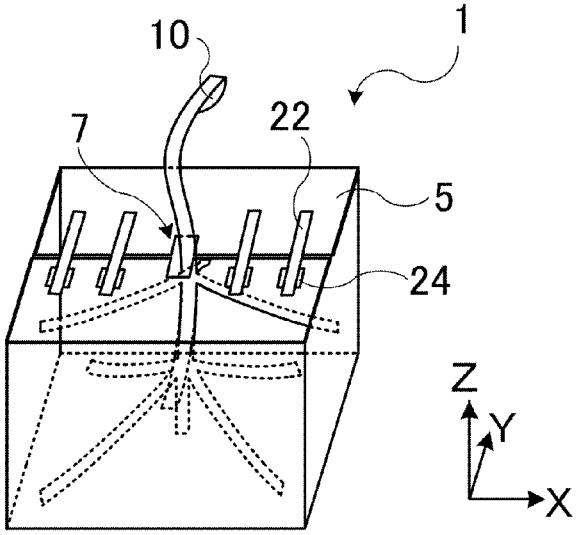
FIG. 1B is an explanatory diagram for illustrating an aspect in which cover portions on a top surface of the rectangular parallelepiped bag are closed.

FIG. 1B illustrates an aspect in which the cover portions 5 on the top surface of the rectangular parallelepiped bag 1 are closed. The cover portions 5 are provided with belts 22 and lock parts 24 for securing the belts 22, respectively, so that the opposed cover portions 5 can be closed. The hook holding portion 10 can be taken out from the rectangular parallelepiped bag 1 through the openings 7. The use of MAGICTAPE (registered trademark) for the lock parts 24 can be contemplated, for example.

Figure 2A:
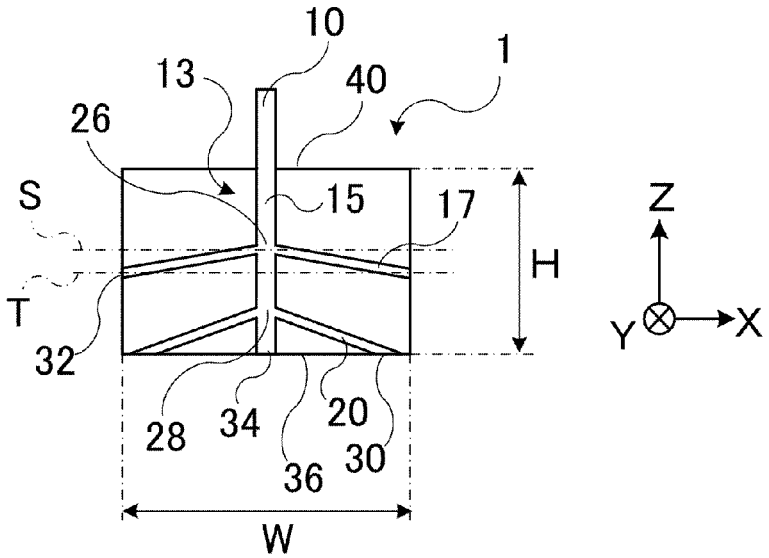
FIG. 2A is a cross-sectional view of the rectangular parallelepiped bag.

FIG. 2A is a cross-sectional view of the rectangular parallelepiped bag 1. The internal restriction tool 13 includes: the central hanging body 15; and the side surface restriction bodies 17 and the hanging bodies 20 held by the central hanging body 15. The side surface restriction bodies 17 are fixed to inner walls of the side surfaces of the rectangular parallelepiped bag 1 at side surface restriction body fixing portions 32 and held by the central hanging body 15 at a side surface restriction body connected portion 26. The hanging bodies 20 are fixed to the bottom surface 36 at hanging body fixing portions 30 and held by the central hanging body 15 at the hanging body connected portion 28. One end of the central hanging body 15 is fixed to the bottom surface 36 at a central hanging body fixing portion 34, and the other end of the central hanging body 15 is connected to the hook holding portion 10. A distance between a side surface restriction body connected plane S including the side surface restriction body connected portion 26 and parallel to the X-Y plane (the bottom surface 36) and a side surface restriction body fixing plane T including the side surface restriction body fixing portions 32 and parallel to the X-Y plane (the bottom surface 36) is smaller than or equal to 5% of a length of the height H of the rectangular parallelepiped bag 1.

Figure 2B:
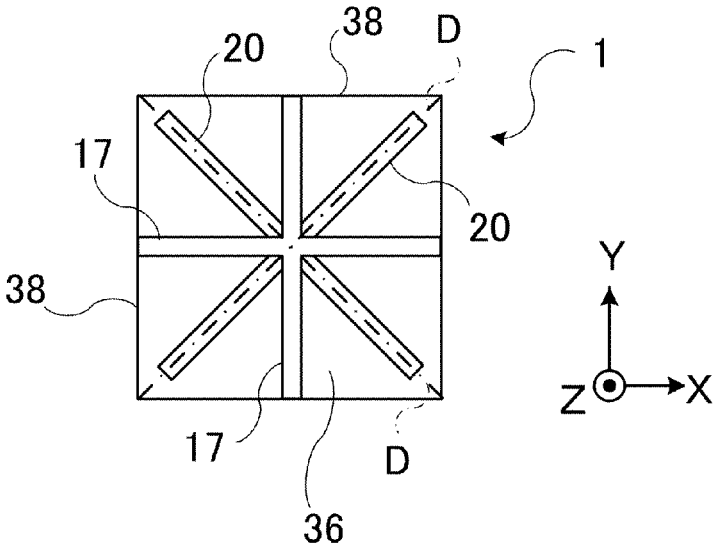
FIG. 2B is a top view of the rectangular parallelepiped bag.

FIG. 2B is a top view of the rectangular parallelepiped bag 1 with the cover portions 5 being omitted. The hanging bodies 20 are stretched along diagonal lines D and fixed to the bottom surface 36. The side surface restriction bodies 17 are stretched in directions perpendicular to the side surfaces 38 and fixed to the side surfaces 38 with their phases being shifted from those of the hanging bodies 20 by 45°.

Figure 3A:
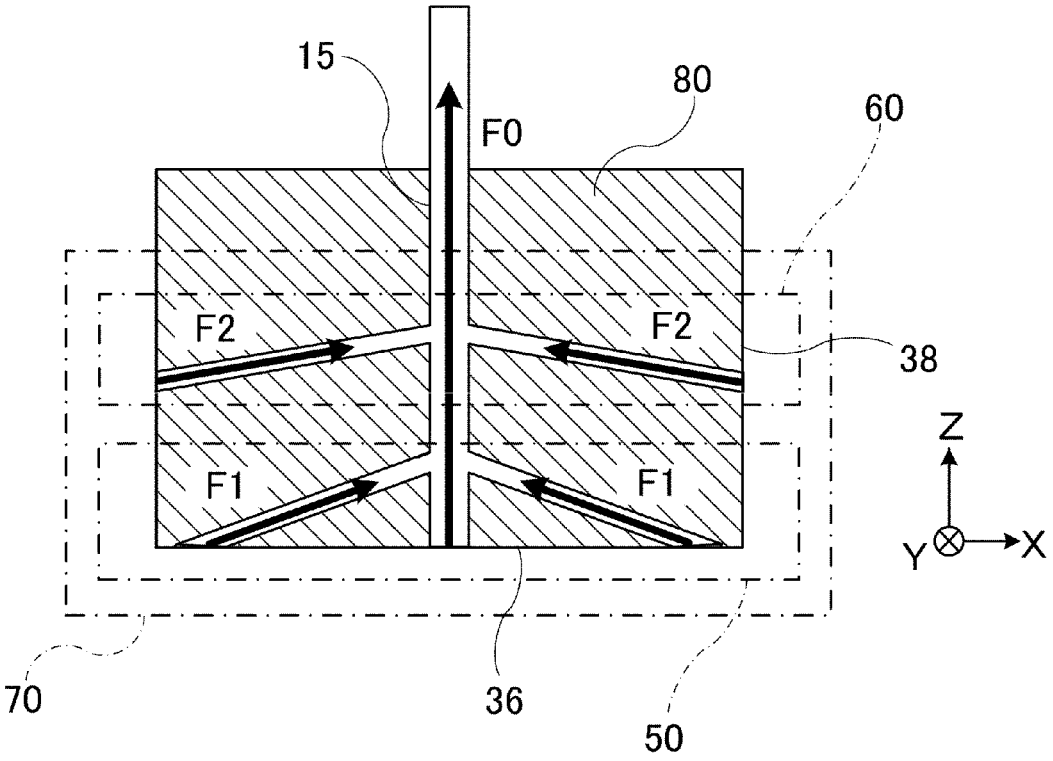
FIG. 3A is an explanatory diagram for tensile forces generated by an internal restriction tool in the rectangular parallelepiped bag.

FIG. 3A is an explanatory diagram for tensile force F generated by the internal restriction tool 13 in the rectangular parallelepiped bag 1. The internal restriction tool 13 holds: the central hanging body 15; the side surface holding mechanism 60 configured to hold the side surfaces 38 by the application of tensile forces thereto; and the bottom surface holding mechanism 70 configured to hold the bottom surface 36 by the application of tensile forces thereto, at intermediate positions of the central hanging body 15 in the vertical direction.

Specifically, when the central hanging body 15 is pulled upwardly in the vertical direction (upwardly in the Z direction) with a force F0, tensile forces F1 are applied to a piece of cloth constituting the bottom surface 36 through the hanging bodies 20. In addition, tensile forces F2 are applied to pieces of cloth constituting the side surfaces 38 through the side surface restriction bodies 17.

Specifically, accommodated objects in the rectangular parallelepiped bag 1 are compacted by a mechanism 70 for compacting accommodated objects, i.e., the bottom surface holding mechanism 50 and the side surface holding mechanism 60.

Figure 3B:
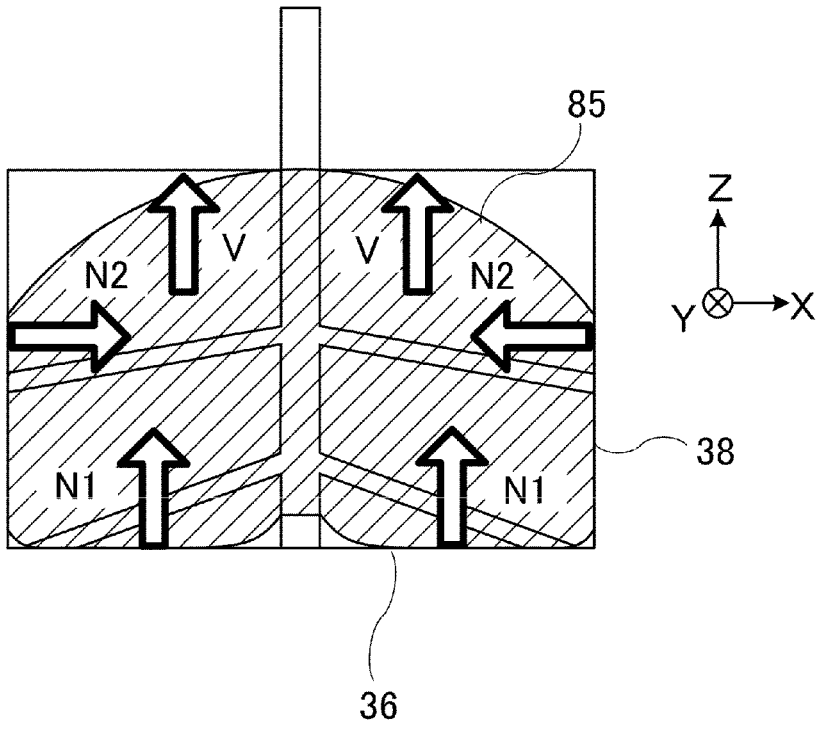
FIG. 3B is an explanatory diagram for resistance and vertical soil pressure received from the cloth of the rectangular parallelepiped bag by accommodated objects.

FIG. 3B is an explanatory diagram for resistance N, etc., received from the cloth of the rectangular parallelepiped bag 1 by accommodated objects 85. The tensile forces F2 (see FIG. 3A) caused by the side surface holding mechanism 60 and resistance N2 resulting from tension of the pieces of cloth constituting the side surfaces 38 are applied to the accommodated objects 80 from the side surfaces 38. The tensile forces F1 (see FIG. 3A) caused by the bottom surface holding mechanism 50 and effectiveness N1 resulting from tension of the piece of cloth constituting the bottom surface 36 are applied to the accommodated objects 80 from the bottom surface 36. As the result, the accommodated objects 80 are compacted over a wide area in the rectangular parallelepiped bag 1 (becoming compacted, accommodated objects 85). Part of the accommodated objects 80 corresponding to a portion above the side surface holding mechanism 60 is also compacted due to the gravity and vertical soil pressure V.

In the shape-retaining hoist type rectangular parallelepiped bag 1 according to the first embodiment of the present invention, the rectangular parallelepiped bag 1 that accommodates the accommodated objects 80 such as soil and sand or crushed stones includes both the bottom surface holding mechanism 50 configured to hold the bottom surface 36 by the application of tensile forces thereto and the side surface holding mechanism 60 configured to hold the side surfaces 38 by the application of tensile forces thereto. This provides an advantageous effect that the extent over which the accommodated objects 80 are compacted is increased in the vertical direction, and thus a rectangular parallelepiped bag less likely to be deformed and having a small aspect ratio (small oblateness) and a large height can be formed.

In the shape-retaining hoist type rectangular parallelepiped bag 1 according to the first embodiment of the present invention, the tensile forces of the hanging bodies 20 that constitute the bottom surface holding mechanism 50 and the tensile forces of the side surface restriction bodies 17 that constitute the side surface holding mechanism 60 have horizontal components of vectors different from one another in the direction parallel to the bottom surface 36. This provides an advantageous effect that the directions of the forces received from the side surfaces 38 by the accommodated objects 80 interfere with one another, and thus force to compact the entire accommodated objects 80 is more likely to be applied uniformly.

In the shape-retaining hoist type rectangular parallelepiped bag 1 according to the first embodiment of the present invention, the directions of the tensile forces of the side surface restriction bodies 17 that constitute the side surface holding mechanism 60, and the directions of the tensile forces of the hanging bodies 20 that constitute the bottom surface holding mechanism 50 can be changed to the largest degree. This provides an advantageous effect that the directions of the forces received from the side surfaces 38 by the accommodated objects 80 are dispersed, and thus the force to compact the accommodated objects 80 is easily applied in the most uniform manner.

As the side surface restriction bodies 17 that exert the tensile forces on the side surfaces 38 are oriented closer to positions perpendicular to the side surfaces 38, the force to compact the entire accommodated objects 80 is more likely to be applied uniformly. As the result, the accommodated objects 80 are more likely to be compacted uniformly. In the shape-retaining hoist type rectangular parallelepiped bag 1 according to the first embodiment of the present invention, the side surface restriction bodies 17 are stretched so as to be almost perpendicular to the side surfaces 38. This provides an advantageous effect that the force to compact the accommodated objects 80 is more likely to be applied uniformly, and thus the rectangular parallelepiped bag 1 less likely to be deformed as a whole can be formed.

In the shape-retaining hoist type rectangular parallelepiped bag 1 according to the first embodiment of the present invention, the hanging bodies 20 that constitute the bottom surface holding mechanism 50 are fixed in between the apexes of the bottom surface 36 and the center of the bottom surface 36. This provides an advantageous effect that the accommodated objects 80 at the bottom, where the vertical soil pressure is largest, are compressed toward a central portion, and thus compaction can be done efficiently. Moreover, there is obtained an advantageous effect that the quick solidification of the accommodated objects 80 at the bottom reduces force applied to the cloth portion of the bottom surface and the sewn portions of the respective members, and thus the cloth that constitutes the bag becomes less likely to tear.

In the shape-retaining hoist type rectangular parallelepiped bag 1 according to the first embodiment of the present invention, a rectangular parallelepiped bag that has a large height can be formed. This provides an advantageous effect that the number of steps needed if the rectangular parallelepiped bags are to be stacked high in layers can be reduced, and thus the construction work can be completed earlier.

Figure 4A:
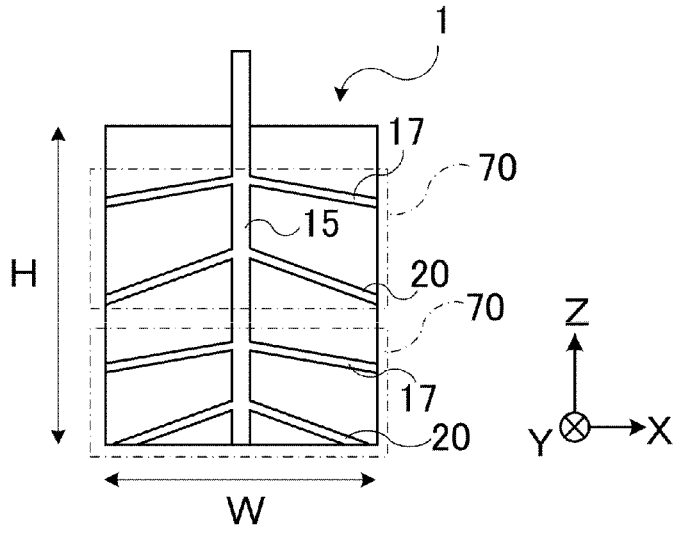
FIG. 4A is a cross-sectional view of a rectangular parallelepiped bag according to a second embodiment of the present invention, illustrating an aspect of how mechanisms for compacting accommodated objects are provided continuously in the vertical direction.

FIG. 4A is a cross-sectional view of a rectangular parallelepiped bag 1 according to a second embodiment of the present invention, illustrating an aspect of how two mechanisms 70 for compacting accommodated objects are provided continuously in the vertical direction. Specifically, a plurality of mechanisms 70 for compacting accommodated objects, each of which includes a bottom surface holding mechanism 50 and a side surface holding mechanism 60 in this order from a bottom surface 36, is held by a central hanging body 15 in the vertical direction.

Hanging bodies 20 that form a truss structure, corresponding to the bottom surface holding mechanism 50 included in the mechanism 70 for compacting accommodated objects on the upper side in the vertical direction are fixed to intermediate positions along sides extending vertically from the respective apexes of the bottom surface 30, i.e., vertical edges. That is, hanging body fixing portions 30 are provided at the intermediate positions along the sides extending vertically from the respective apexes of the bottom surface 30, i.e., the vertical edges.

Providing the plurality of mechanisms 70 for compacting accommodated objects enables force to compact accommodated objects 80 to be easily applied uniformly over a wide area in the vertical direction. Consequently, a rectangular parallelepiped bag less likely to tear and having a large height can be formed. Although FIG. 4A shows an example in which two mechanisms 70 for compacting accommodated objects are provided continuously, three or more mechanisms 70 for compacting accommodated objects may be provided.

The shape-retaining hoist type rectangular parallelepiped bag 1 according to the second embodiment of the present invention can provide an advantageous effect that a rectangular parallelepiped bag less likely to be deformed and having a small aspect ratio and a large height can be formed.

Figure 4B:
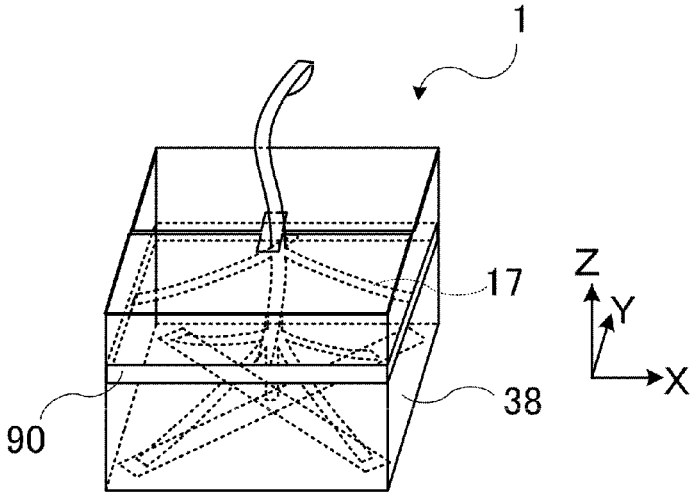
FIG. 4B is an explanatory diagram for a rectangular parallelepiped bag according to a third embodiment of the present invention, illustrating an aspect of how side surface restriction body fixing portions (positions where side surface restriction bodies are fixed) are provided on a reinforcement body for the fixation of the side surface restriction bodies.

FIG. 4B is an explanatory diagram for a rectangular parallelepiped bag 1 according to a third embodiment of the present invention, illustrating an aspect of how side surface restriction body fixing portions 32 (positions where side surface restriction bodies 17 are fixed) are provided on a reinforcement body 90 for the fixation of the side surface restriction bodies. A material that has a higher tensile strength than cloth of the rectangular parallelepiped bag 1, for example, chemical fiber that has a sufficient strength, is preferably used as a material of the reinforcement body 90 for the fixation of the side surface restriction bodies. The reinforcement body 90 for the fixation of the side surface restriction bodies desirably has a belt shape with a thickness larger than that of the cloth. Including such a reinforcement structure enables part of the tension on side surfaces 38 to be taken over by the reinforcement structure, thereby increasing the durability of the cloth. Consequently, there are obtained advantageous effects that large resistance N2 (see FIG. 3B) given from the side surfaces 38 to the accommodated objects 80 can be easily maintained, and force to compact the accommodated objects 80 can be further increased.

Figure 4C:
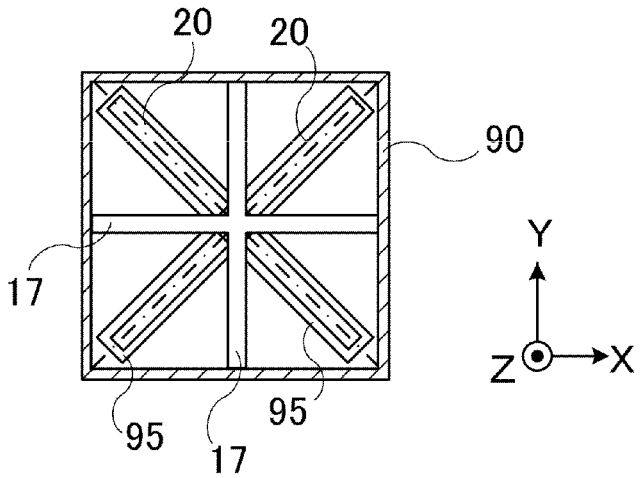
FIG. 4C is a top view illustrating an aspect of how hanging bodies and a central hanging body are fixed to bottom surface reinforcement bodies.

FIG. 4C is a top view illustrating an aspect of how hanging bodies 20 and a central hanging body 15 are fixed to bottom surface reinforcement bodies 95. Specifically, a central hanging body fixing portion 34 and hanging body fixing portions 30 are fixed to the bottom surface reinforcement bodies 95. A material that has a higher tensile strength than the cloth of the rectangular parallelepiped bag 1, for example, chemical fiber that has a sufficient strength, is preferably used as a material of the bottom surface reinforcement bodies 95. The bottom surface reinforcement body 95 desirably has a belt shape with a thickness larger than that of the cloth. Including such a reinforcement structure enables part of the tension on a bottom surface 36 to be taken over by the reinforcement structure, thereby increasing the durability of the cloth. Consequently, there are obtained advantageous effects that large resistance N1 (see FIG. 3B) given from the bottom surface 36 to the accommodated objects 80 can be easily maintained, and force to compact the accommodated objects 80 can be further increased.

A method of utilizing the rectangular parallelepiped bags according to the above-described embodiments will be described next.

Figure 5A:
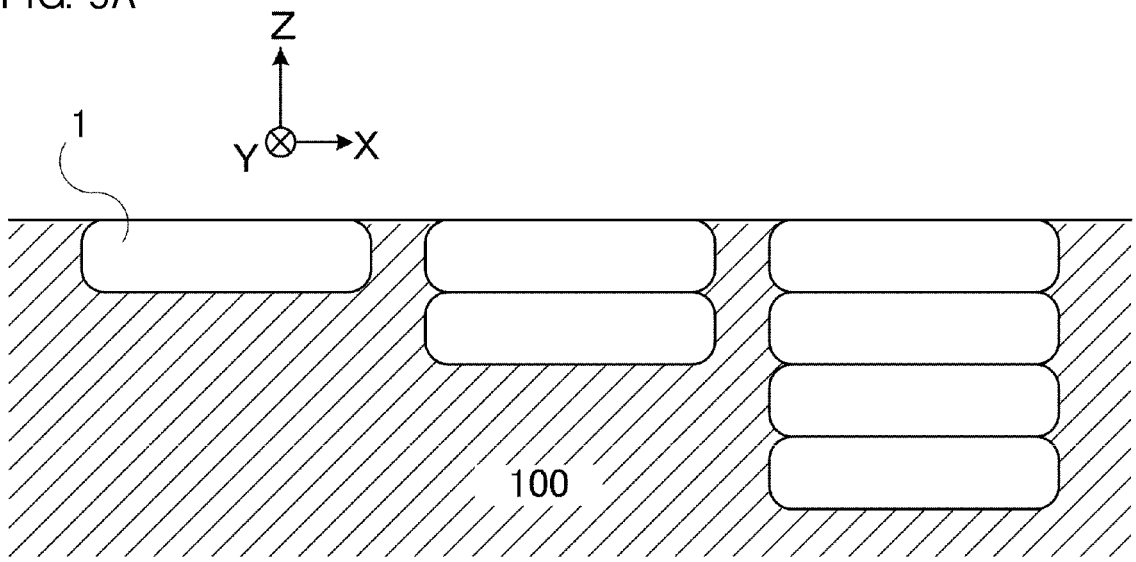
FIG. 5A is an explanatory diagram for illustrating an aspect of how conventional flat rectangular parallelepiped bags are used to improve soft ground.

FIG. 5A is an explanatory diagram for illustrating an aspect of how conventional flat rectangular parallelepiped bags 1 are used to improve soft ground. If a rectangular parallelepiped bag that has a large height is to be buried into soft ground in order to improve soft ground 100, a plurality of rectangular parallelepiped bags 1 conventionally need to be stacked in layers due to its flat shape. This increases the number of steps and cost.

Figure 5B:
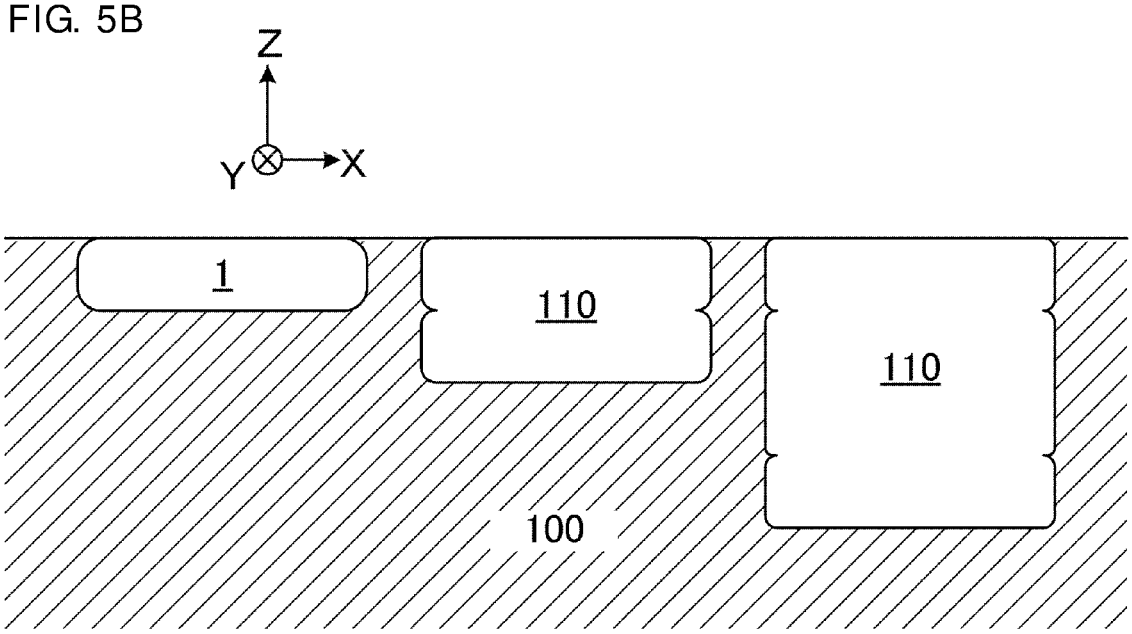
FIG. 5B is an explanatory diagram for illustrating an aspect of how a rectangular parallelepiped bag that has a large height is used.

In contrast, FIG. 5B is an explanatory diagram for illustrating an aspect of how a rectangular parallelepiped bag 110 that has a large height is used. When a large height is required, the rectangular parallelepiped bag 110 that has a sufficient strength and a large height can be obtained by using the rectangular parallelepiped bag (see FIG. 1A) that includes the internal restriction tool 13 having the side surface restriction bodies 17, or the rectangular parallelepiped bag (see FIG. 4A) that includes a plurality of mechanisms 70 for compacting accommodated objects. This allows for the omission of the stacking step, thus leading to the shortening of the construction period and cost reduction, too.

Figure 6A:
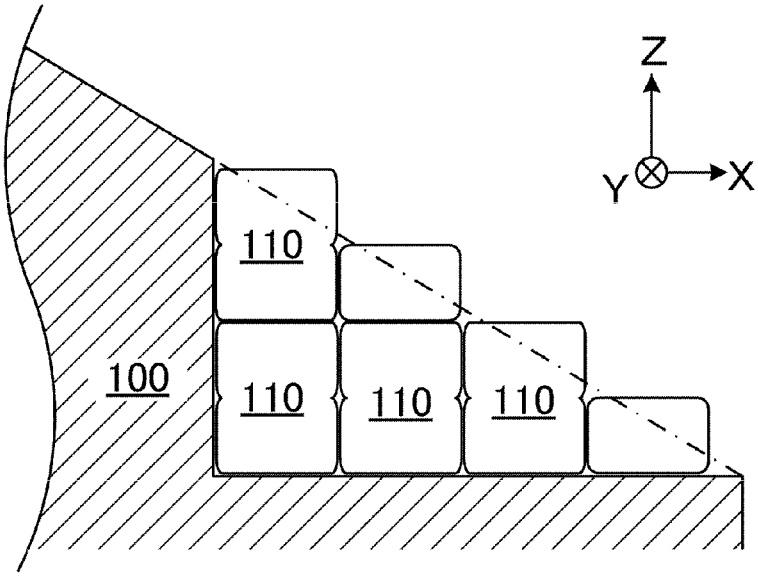
FIG. 6A is an explanatory diagram for a method to remedy a landslide using the rectangular parallelepiped bags that have a large height.

FIG. 6A is an explanatory diagram for a method to remedy a landslide using the rectangular parallelepiped bags 110 that have a large height. The soft ground 100 may cause a landslide, resulting in the formation of a slope with a large angle. Such a slope is more likely to collapse again, and thus a reinforcement work needs to be done in a short construction period. Such a construction work is, however, difficult to be done due to the presence of collapsed soil and sand, and is dangerous, too. In such a case, by using the rectangular parallelepiped bag that has a large height according to the present invention, the collapsed soil and sand can be packed into the bag and compacted, thus obtaining the rectangular parallelepiped bag that has a high strength. The reinforcement work can be easily done by placing such rectangular parallelepiped bags. The soft ground 100 under the rectangular parallelepiped bags is also improved and becomes solid.

Figure 6B:
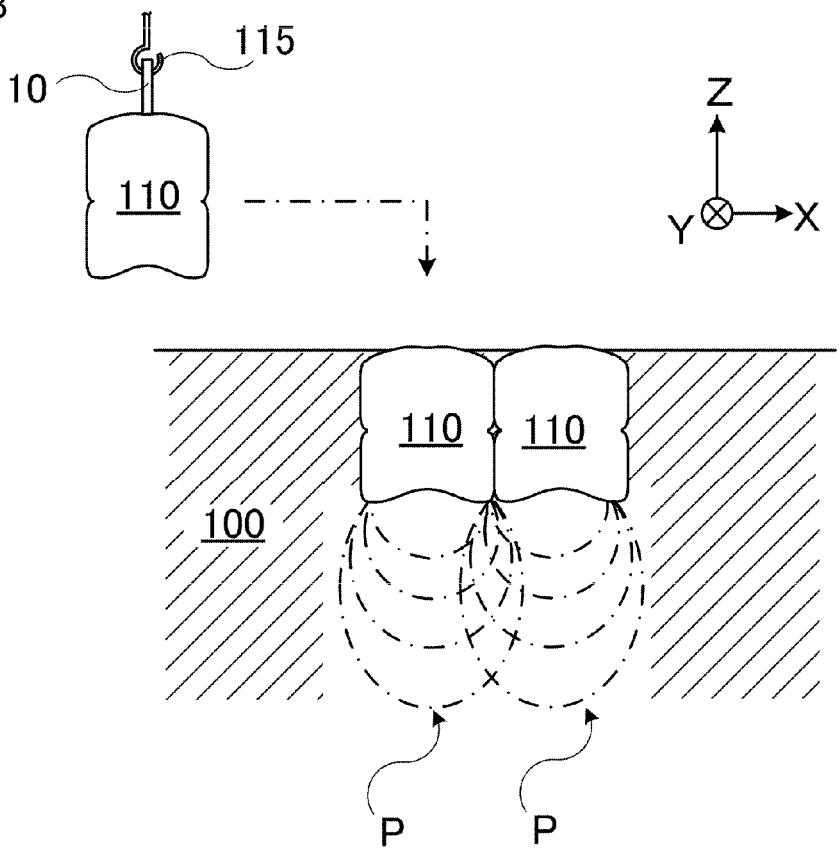
FIG. 6B is a conceptual diagram illustrating stress in the ground (pressure bulbs) generated by the rectangular parallelepiped bags.
Figure 7A:
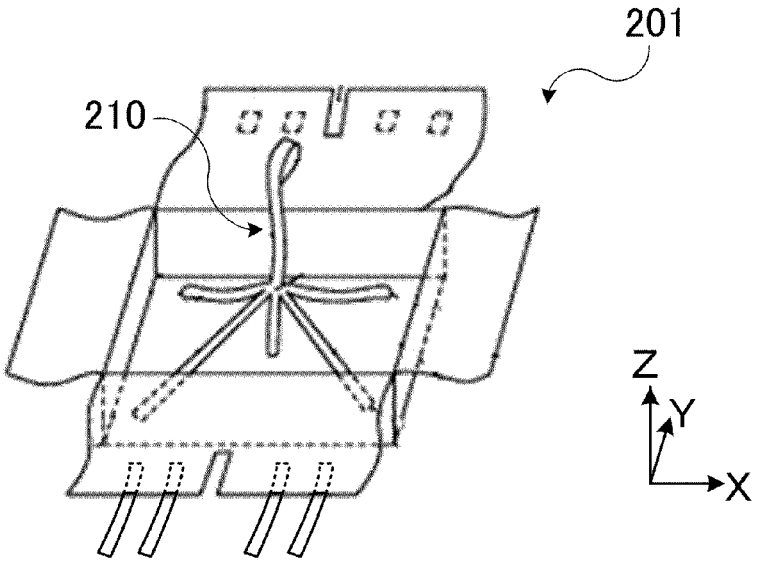
FIG. 7A Related Art
FIG. 7A is an explanatory diagram for a conventional rectangular parallelepiped bag including an internal restriction tool.
Figure 7B:
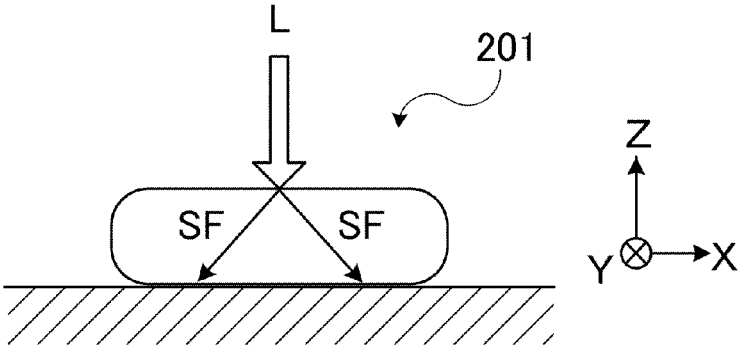
FIG. 7B Related Art
FIG. 7B is a conceptual diagram for explaining shear forces generated by a load applied from the above in a flat rectangular parallelepiped bag.
Figure 7C:
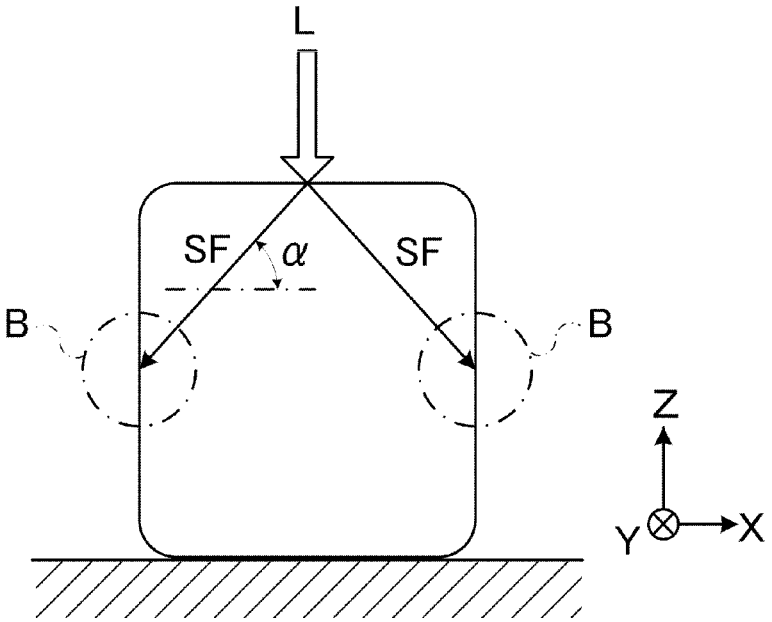
FIG. 7C Related Art
FIG. 7C is a conceptual diagram for explaining how shear forces generated by a load applied from the above are applied to side surfaces and cause their rupture in a rectangular parallelepiped bag that has a large height.
Figure 8A:
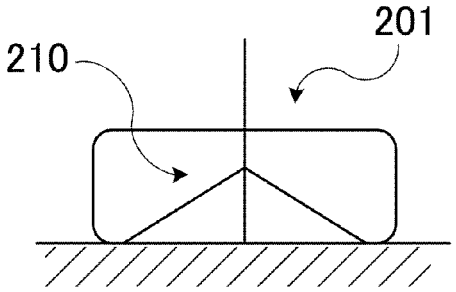
FIG. 8A Related Art
FIG. 8A is an explanatory diagram for a conventional flat rectangular parallelepiped bag including an internal restriction tool.
Figure 8B:
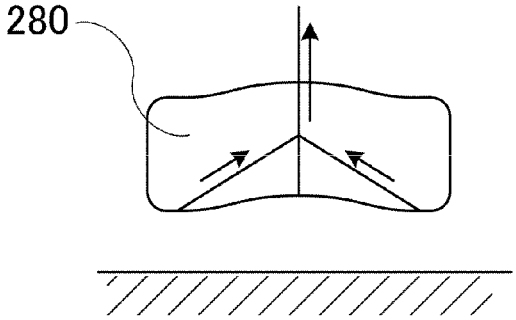
FIG. 8B Related Art
FIG. 8B is an explanatory diagram for deformation caused when the flat rectangular parallelepiped bag is lifted.
Figure 8C:
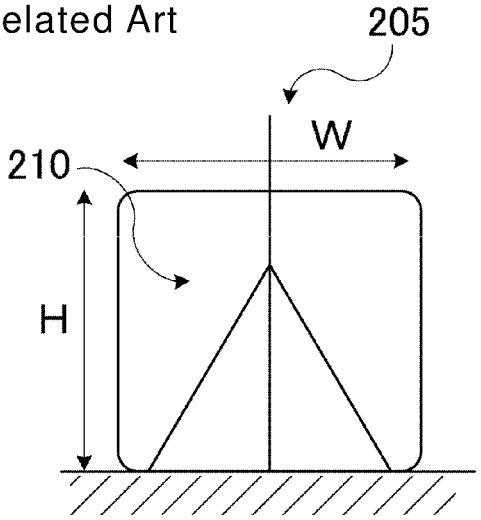
FIG. 8C Related Art
FIG. 8C is an explanatory diagram for a rectangular parallelepiped bag that has a small length-to-width cost and a large height.
Figure 8D:
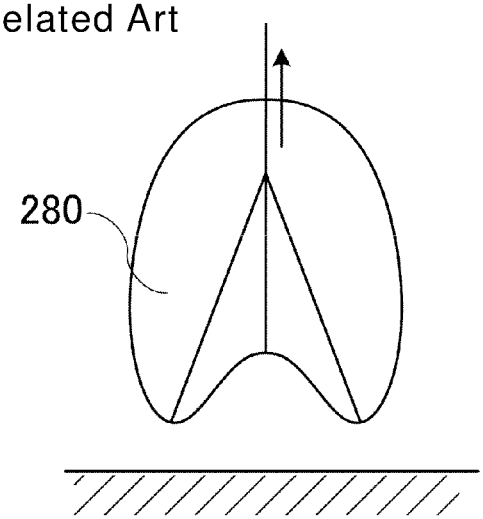
FIG. 8D Related Art
FIG. 8D is an explanatory diagram for deformation caused when the rectangular parallelepiped bag that has a small aspect ratio and a large height is lifted.

FIG. 6B is a conceptual diagram illustrating stress in the ground (pressure bulbs) generated in the soft ground 100 by the rectangular parallelepiped bags. As indicated by dashed-dotted lines in FIG. 6B, pressure bulbs P are formed downwardly in the vertical direction directly under the rectangular parallelepiped bags 110. The influencing extent in terms of the depth and magnitude of such a pressure bulb is determined in accordance with the conditions of a load applied thereon. Since the meshes of the cloth serve as a filter, the rectangular parallelepiped bag 1 allows water to pass therethrough without allowing the passage of soil particles and causes the soft ground 100 directly under the rectangular parallelepiped bag 110 to be consolidated locally in the shape of a pressure bulb. Consequently, the support force of the ground is increased. When a foundation such as ordinary concrete is laid, conditions in soil under the foundation vary. Thus, pore water pressure rises at irregular positions. This causes uneven settlement or the like, and the pressure bulbs are also formed at irregular positions. When the ground is compacted by single-plane loading such as preload, unnecessary part of the ground is also consolidated. Consequently, it takes time to discharge water, and the increased influencing extent may impose negative effects on the surrounding area. In the rectangular parallelepiped bag, however, soft soil particles are confined within a conical portion generated under the rectangular parallelepiped bag. The soil particles in the conical portion are thus compartmented from their surroundings and subjected only to a compression condition. Therefore, the soil particles will not fracture easily. This is because soil has characteristics of being fractured easily by shear, but not by compression. This can form a temporal resisting surface, and thus a large load can be applied immediately after the placement. Furthermore, this enables only a necessary ground portion immediately under the rectangular parallelepiped bag to be compressed precisely and consolidated forcibly. Because the rectangular parallelepiped bag allows water, but not soil particles, to pass therethrough, liquefaction can be prevented from occurring. In addition, if crushed stones are put into the rectangular parallelepiped bag 1, interspace between the crushed stones is large, and thus no water goes up due to capillary action. Therefore, there is obtained an advantageous effect that frost heave is less likely to occur.

Furthermore, wrapping and tightly enclosing soil and sand or crushed stones in the rectangular parallelepiped bag 1 enables a sufficient strength to be obtained without using an adhesive material such as cement. This can eliminate worries about soil contamination due to alkali or hexavalent chromium. At the same time, very small stretchability of the bag itself allows the energy of traffic vibration or seismic shake to be dissipated as frictional energy among the soil particles, i.e., the accommodated objects, packed therein. Therefore, there is obtained an advantageous effect of reducing vibration.

Note that the shape-retaining hoist type rectangular parallelepiped bags according to the present invention are not limited to those of the above-described embodiments. It is apparent that various modifications can be made thereto without departing from the scope of the present invention.

For example, although a total of four hanging bodies 20 that are included in the bottom surface holding mechanism 50 and form a truss structure are provided along the diagonal lines of the bottom surface 36 (one for each) in the above-described embodiment (see FIG. 1), a plurality of truss structures may be provided. For example, eight or more hanging bodies 20 may be provided. Similarly, a plurality of side surface restriction bodies 17 may be provided for each of the side surfaces 38.

The invention claimed is:

1. A shape-retaining hoist type rectangular parallelepiped bag comprising:

a rectangular parallelepiped bag that is substantially rectangular parallelepiped-shaped and that has an internal space to accommodate an accommodated object;

a bottom surface holding mechanism holding a bottom surface of the rectangular parallelepiped bag by application of a first tensile force to the bottom surface;

a side surface holding mechanism holding side surfaces of the rectangular parallelepiped bag by application of a second tensile force to the side surfaces;

a central hanging body extending in a vertical direction, one end of the central hanging body being fixed to a center of the bottom surface of the rectangular parallelepiped bag, the central hanging body holding the bottom surface holding mechanism and the side surface holding mechanism at first and second intermediate positions thereof in the vertical direction, respectively; and a ring-shaped hook holding portion connected to the other end of the central hanging body, the ring-shaped hook holding portion being configured to be attached to a hook, wherein the bottom surface holding mechanism includes at least four hanging bodies, one ends of the at least four hanging bodies are respectively fixed at positions of the bottom surface that are respectively spaced apart from the center of the bottom surface by predetermined distances on diagonal lines connecting between opposed apexes of the bottom surface, the other ends of the at least four hanging bodies are connected to the first intermediate position of the central hanging body, the side surface holding mechanism includes a plurality of side surface restriction bodies, horizontal components of vectors of the plurality of side surface restriction bodies extend in directions different from those of the at least four hanging bodies when viewed along the vertical direction, one ends of the plurality of side surface restriction bodies are fixed to the side surfaces, the other ends of the plurality of side surface restriction bodies are connected to the second intermediate position of the central hanging body, and the first intermediate position and the second intermediate position of the central hanging body are spaced apart from each other, and the second intermediate position is located closer to the other end of the central hanging body than the first intermediate position.

2. The shape-retaining hoist type rectangular parallelepiped bag according to claim 1, wherein the side surfaces include four side surfaces, the one ends of the plurality of side surface restriction bodies are fixed to the four side surfaces, and an angle, when viewed along the vertical direction, between one of the plurality of side surface restriction bodies of the side surface holding mechanism and one of the at least four hanging bodies of the bottom surface holding mechanism is 45°.

3. The shape-retaining hoist type rectangular parallelepiped bag according to claim 2, wherein a distance between a side surface restriction body fixing plane and a side surface restriction body connected plane is smaller than or equal to 5% of a height of the rectangular parallelepiped bag, the side surface restriction body fixing plane includes side surface restriction body fixing portions on the side surfaces to which the one ends of the plurality of side surface restriction bodies are fixed and is parallel to the bottom surface, and the side surface restriction body connected plane includes the second intermediate position of the central hanging body and is parallel to the bottom surface.

4. The shape-retaining hoist type rectangular parallelepiped bag according to claim 2, wherein the positions of the bottom surface at which the one ends of the at least four hanging bodies are fixed are in between the center of the bottom surface and the respective apexes of the bottom surface.

5. The shape-retaining hoist type rectangular parallelepiped bag according to claim 2, wherein a height of the rectangular parallelepiped bag is ⅓ or more of a length of a side of the bottom surface.

6. The shape-retaining hoist type rectangular parallelepiped bag according to claim 1, wherein the side surfaces include four side surfaces, and the plurality of side surface restriction bodies of the side surface holding mechanism include at least four side surface restriction bodies, the one ends of the at least four side surface restriction bodies are respectively fixed at four positions of the four side surfaces, and the four positions are spaced apart from the bottom surface by predetermined distances on perpendicular bisectors of respective sides corresponding to lines of intersection between the four side surfaces and the bottom surface.

7. The shape-retaining hoist type rectangular parallelepiped bag according to claim 6, wherein a distance between a side surface restriction body fixing plane and a side surface restriction body connected plane is smaller than or equal to 5% of a height of the rectangular parallelepiped bag, the side surface restriction body fixing plane includes side surface restriction body fixing portions on the side surfaces to which the one ends of the plurality of side surface restriction bodies are fixed and is parallel to the bottom surface, and the side surface restriction body connected plane includes the second intermediate position of the central hanging body and is parallel to the bottom surface.

8. The shape-retaining hoist type rectangular parallelepiped bag according to claim 6, wherein the positions of the bottom surface at which the one ends of the at least four hanging bodies are fixed are in between the center of the bottom surface and the respective apexes of the bottom surface.

9. The shape-retaining hoist type rectangular parallelepiped bag according to claim 6, wherein a height of the rectangular parallelepiped bag is ⅓ or more of a length of a side of the bottom surface.

10. The shape-retaining hoist type rectangular parallelepiped bag according to claim 1, further comprising:

a plurality of object compacting mechanisms configured to accommodate the accommodated object, wherein each of the plurality of object compacting mechanisms includes the bottom surface holding mechanism and the side surface holding mechanism, and the plurality of object compacting mechanisms are arranged from the bottom surface along the vertical direction.

11. The shape-retaining hoist type rectangular parallelepiped bag according to claim 10, wherein a distance between a side surface restriction body fixing plane and a side surface restriction body connected plane is smaller than or equal to 5% of a height of the rectangular parallelepiped bag, the side surface restriction body fixing plane includes side surface restriction body fixing portions on the side surfaces to which the one ends of the plurality of side surface restriction bodies are fixed and is parallel to the bottom surface, and the side surface restriction body connected plane includes the second intermediate position of the central hanging body and is parallel to the bottom surface.

12. The shape-retaining hoist type rectangular parallelepiped bag according to claim 10 wherein the positions of the bottom surface at which the one ends of the at least four hanging bodies are fixed are in between the center of the bottom surface and the respective apexes of the bottom surface.

13. The shape-retaining hoist type rectangular parallelepiped bag according to claim 10, wherein a height of the rectangular parallelepiped bag is ⅓ or more of a length of a side of the bottom surface.

14. The shape-retaining hoist type rectangular parallelepiped bag according to claim 1, wherein a distance between a side surface restriction body fixing plane and a side surface restriction body connected plane is smaller than or equal to 5% of a height of the rectangular parallelepiped bag, the side surface restriction body fixing plane includes side surface restriction body fixing portions on the side surfaces to which the one ends of the plurality of side surface restriction bodies are fixed and is parallel to the bottom surface, and the side surface restriction body connected plane includes the second intermediate position of the central hanging body and is parallel to the bottom surface.

15. The shape-retaining hoist type rectangular parallelepiped bag according to claim 1, wherein the positions of the bottom surface at which the one ends of the at least four hanging bodies are fixed are in between the center of the bottom surface and the respective apexes of the bottom surface.

16. The shape-retaining hoist type rectangular parallelepiped bag according to claim 15, wherein a distance between a side surface restriction body fixing plane and a side surface restriction body connected plane is smaller than or equal to 5% of a height of the rectangular parallelepiped bag, the side surface restriction body fixing plane includes side surface restriction body fixing portions on the side surfaces to which the one ends of the plurality of side surface restriction bodies are fixed and is parallel to the bottom surface, and the side surface restriction body connected plane includes the second intermediate position of the central hanging body and is parallel to the bottom surface.

17. The shape-retaining hoist type rectangular parallelepiped bag according to claim 1, wherein a height of the rectangular parallelepiped bag is ⅓ or more of a length of a side of the bottom surface.

18. The shape-retaining hoist type rectangular parallelepiped bag according to claim 17, wherein a distance between a side surface restriction body fixing plane and a side surface restriction body connected plane is smaller than or equal to 5% of a height of the rectangular parallelepiped bag, the side surface restriction body fixing plane includes side surface restriction body fixing portions on the side surfaces to which the one ends of the plurality of side surface restriction bodies are fixed and is parallel to the bottom surface, and the side surface restriction body connected plane includes the second intermediate position of the central hanging body and is parallel to the bottom surface.

19. The shape-retaining hoist type rectangular parallelepiped bag according to claim 17, wherein the positions of the bottom surface at which the one ends of the at least four hanging bodies are fixed are in between the center of the bottom surface and the respective apexes of the bottom surface.

* * * * *